US005985098A

United States Patent [19]

Lehleiter et al.

[11] Patent Number: 5,985,098

[45] Date of Patent: Nov. 16, 1999

[54] CONTINUOUSLY VARIABLE SECTIONED HEADBOX

[75] Inventors: Klaus Lehleiter, Mengen; Hans Loser, Langenau; Wolfgang Ruf, Herbrechtingen, all of Germany

[73] Assignee: Voith Sulzer Papiermaschinen GmbH, Heidenheim, Germany

[21] Appl. No.: 09/083,034

[22] Filed: May 22, 1998

[30] Foreign Application Priority Data

Jun. 6, 1997 [DE] Germany ..... 197 23 860

[51] Int. Cl.[6] ..... D21F 1/06; D21F 1/08; D21F 11/00

[52] U.S. Cl. ..... 162/198; 162/252; 162/258; 162/DIG. 11; 162/343

[58] Field of Search ..... 162/DIG. 10, DIG. 11, 162/258, 259, 256, 254, 252, 253, 343, 336, 345

[56] References Cited

U.S. PATENT DOCUMENTS 5,419,813 5/1995 Heinzmann .
5,707,495 1/1998 Heinzmann et al. .

FOREIGN PATENT DOCUMENTS 3741603 6/1989 Germany .
3808050 12/1989 Germany .
4019593 1/1992 Germany .
4025874 2/1992 Germany .

OTHER PUBLICATIONS

German Search Report dated Nov. 3, 1997 conducted in German Patent Application No. 197 23 860.2.

*Primary Examiner*—Stanley S. Silverman
*Assistant Examiner*—Kevin Cronin
*Attorney, Agent, or Firm*—Greenblum & Bernstein, P.L.C.

[57] ABSTRACT

Apparatus for influencing a cross-sectional profile of a headbox having an inner chamber and process for determining a width and position for the sections of the headbox. The apparatus includes a device for distributing fluid that extends across a machine width, at least one connection opening extending across the machine width between the fluid distribution device and the inner chamber of the headbox, and a plurality of elements being one of continuously and discretely adjustably positionable within the fluid distributing device to section the fluid distributing device across the machine width. The process includes measuring a profile of a selected characteristic of the pulp suspension in the headbox that is dependent on its position; forming intersecting points of the profile of the characteristic with a uniform sectioning of the size of the characteristic under consideration; and determining the position and width of the sections. In this regard, the width of respective sections correspond to a respective distance of the points of intersection of the profile of the characteristic with the uniform sectioning of the size of the characteristic under consideration, and the position is determined by the intermediate space between two respectively adjacent points of intersection of the profile of the characteristic with the uniform sectioning of the size of the characteristic under consideration.

4 Claims, 5 Drawing Sheets

CONTINUOUSLY VARIABLE SECTIONED HEADBOX

CROSS-REFERENCE TO RELATED APPLICATIONS

The present application claims priority under 35 U.S.C. § 119 of German Patent Application No. 197 23 860.2, filed on Jun. 6, 1997, the disclosure of which is expressly incorporated by reference herein in its entirety.

BACKGROUND OF THE INVENTION

1. Field of the Invention

The present invention relates to a headbox of a paper machine or a cardboard machine having a plurality of devices positioned across a machine width for sectionally influencing a characteristic of the pulp suspension; to an apparatus for influencing a cross-section profile of a headbox having a device transversely positioned across a machine width for distributing a fluid, at least one connecting opening transversely positioned across the machine width between the fluid distributing device and an inner chamber of the head box, and a plurality of devices that sectionally influence a pulp suspension characteristic; and to a process for determining the position and width of the sections of a headbox.

2. Discussion of Background Information

Headboxes with devices for the sectional influencing of a characteristic of the pulp suspension are generally known in the art. German Patent Application No. DE 37 41 603, for example, describes a headbox arrangement in which a diluting fluid is supplied to the headbox in a vicinity of a compensation channel located between two turbulence generators. The dilution fluid is supplied through supply points that are uniformly distributed across a width of the headbox, and the single supply amounts can be adjusted individually.

Another possibility for influencing a characteristic of the pulp suspension is discussed in German Patent Application No. DE 40 19 593. This document describes a headbox that exhibits a uniformly distributed sectioning and that enables varying of the pulp concentration sectionally and/or the pulp suspension amount per section.

Common to the headboxes described above is that the devices that cause the sectioning of the headbox are uniformly distributed across a width of the headbox and are fixed in their positions. In this manner, the headboxes of the prior art have permanently adjusted sections in which a width of individual sections is permanently defined. This embodiment of the headbox, and, in particular, the sectioning of the headbox, provides the advantage that an inexpensive manufacture of the headbox is possible and that the regulation tasks arising during the influencing of the characteristics of the pulp suspension, can be easily solved.

However, a problem of the prior art headboxes lies in that characteristic alterations of the pulp suspension, as observed across the width of the headbox, are not equally large at all points, i.e., there are regions in the headbox, e.g., the peripheral regions, in which relatively large characteristic alterations occur, while there are other regions in which only very minor characteristic alterations of the pulp suspension from the ideal condition occur. Thus, it was necessary in the prior art to keep a section width as small as possible, so that an alteration of the characteristics did not become too large across a section. This requires that the number of sections sharply increases with the desired refinement of the adjustment possibilities and likewise increases the costs of production enormously.

SUMMARY OF THE INVENTION

The present invention provides a headbox of a paper machine or a cardboard machine having a plurality of devices positioned across a machine width for sectionally influencing a characteristic of the pulp suspension to provide a regulation as narrowly as possible at points of greater change in the characteristic. The headbox of the present invention provides the above advantage while keeping the number of the control elements down.

In accordance with the features of the present invention, the headbox of a paper machine or cardboard machine may be altered with a plurality of devices for sectioning the headbox that are distributed across the machine width, and which may be adjustably positioned across the machine width. In accordance with the present invention, the positioning of these devices may proceed either in a continuously variable manner or in discrete steps.

Further, it may be advantageous if the devices have either a differentiated effective width or adjustable effective widths. This may also be possible in a continuously variable manner or in discrete steps.

In another embodiment of the present invention, a device for influencing the cross-section profile of a headbox is provided that includes at least one connection opening running transversely across a machine width, between the devices for distributing the fluid and an interior chamber of the headbox, and a device running transversely across the machine width for distributing the fluid having a plurality of devices for sectionally influencing a pulp suspension characteristic. In this manner, a distance of the devices for the sectional regulation of the pulp suspension characteristic can be adjusted transversely to a machine direction in discrete steps or continuously.

In another embodiment of the present invention, a device for the regulation of the cross-section profile of a head box is provided that includes a device for distributing a fluid that runs transversely across a width of the machine and has either at least one connection opening running across the machine width or a plurality of connection openings arranged transversely across the machine width between the device for distributing the fluid and an inner chamber of the headbox, and a plurality of devices for the sectioning of the device for distributing the fluid arranged transverse to the machine direction. In this manner, a distance of the devices for the sectioning of the device for the distributing the fluid can be adjusted in discrete steps or can be adjusted continuously.

The present invention also includes a process for determining a position and width of the sections of a headbox. The process includes measuring a profile of a selected characteristic of the pulp suspension in the headbox that is dependent on its position; forming intersecting points of the profile of the characteristic with a uniform sectioning of the size of the characteristic under consideration; and determining the position and width of the sections. In this regard, the width of respective sections correspond to a respective distance of the points of intersection of the profile of the characteristic with the uniform sectioning of the size of the characteristic under consideration, and the position is determined by the intermediate space between two respectively adjacent points of intersection of the profile of the characteristic with the uniform sectioning of the size of the characteristic under consideration.

In a further embodiment of the present invention, the process for determining the position and width of the sections of a headbox may include determining the profile of a selected characteristic E of a pulp suspension in the headbox that is dependent on its position s, where E=f (s); selecting an arbitrary, preferably edge-sided, starting point $E_0$ across a machine width; predetermining a maximal deviation of a characteristic $\Delta E_{max}$; iteratively determining a nearest adjacent point $E_N$ of the characteristic profile, for which the following equation is valid:

$$E_N=E_0\pm|\Delta E_{max}|,$$

where adjacent point $E_N$ is used for the next iteration as starting point $E_0$ until an end of the machine is reached; and determining a position and a width of the sections. In this manner, the width of respective sections corresponds to a respective distance of points $E_N$, and the position is determined by an intermediate space between two adjacent points $E_N$.

Accordingly, the present invention is directed to a headbox of a paper or cardboard machine that includes a plurality of devices located across a machine width adapted to sectionally influence at least one characteristic of a pulp suspension. The plurality of devices may be adjustably positionable across the width of the machine.

In accordance with another feature of the present invention, the position of the plurality of devices is adjustable continuously across the width of the machine.

In accordance with another feature of the present invention, the position of the plurality of devices is adjustable in discrete steps across the width of the machine.

In accordance with still another feature of the present invention, the plurality of devices are composed of elements having varying effective widths. Further, the effective width of the plurality of devices is adapted to be adjusted, e.g., continuously. Still further, the plurality of devices may include a varying device having a variable effective width that may be selected at a desired position.

The present invention is directed to an apparatus for influencing a cross-sectional profile of a headbox having an inner chamber. The apparatus may include a fluid distributing device extending transverse to a machine width, at least one connecting opening extending transverse to the machine width coupling the fluid distributing device the fluid and the inner chamber, a plurality of devices adapted to sectionally influence a characteristic of a pulp suspension, and the plurality of devices being adjustably positionable in one of discrete steps and continuously.

The present invention is directed to an apparatus for influencing a cross-sectional profile of a headbox having an inner chamber. The apparatus includes a device for distributing fluid that extends across a machine width, at least one connection opening extending across the machine width between the fluid distribution device and the inner chamber of the headbox, and a plurality of elements being one of continuously and discretely adjustably positionable within the fluid distributing device to section the fluid distributing device across the machine width.

In accordance with another feature of the present invention, the at least one connection opening may include a plurality of connection openings positioned across the machine width.

The present invention is also directed to a process for determining a position and width of sections of a headbox. The method includes measuring a profile of at least one characteristic of a pulp suspension that varies across a width of the headbox, uniformly dividing the at least one characteristic profile into substantially same sized units related to the at least one characteristic, and indicating points of intersection on the at least one characteristic profile of the same sized units related to the at least one characteristic. The method also includes ascertaining a width of a respective section in accordance with a respective distance, with respect to the width of the headbox, between two adjacent points of intersection on the at least one characteristic profile, and ascertaining a position of the respective section in accordance with a position of an intermediate space located between the two adjacent points of intersection on the at least one characteristic profile.

The present invention also is directed to a process for determining the position and width of the sections of a headbox that includes determining a profile of a selected characteristic E of a pulp suspension in the headbox that varies in accordance with a position s across the head box, such that E=f(s), selecting an arbitrary starting point $E_0$ along a machine width, determining a maximal deviation of the selected characteristic $\Delta E_{max}$, and iteratively determining a nearest adjacent point $E_N$ of the selected characteristic profile, for which the following relation is satisfied:

$$E_N=E_0\pm|\Delta E_{max}|,$$

in which adjacent point $E_N$ is utilized for a next iteration as starting point $E_0$ until an end of the machine width is reached. The process also includes determining a width of the sections that corresponds to a respective distance between the points $E_N$, and determining a position from an intermediate space between two adjacent points $E_N$.

In accordance with another feature of the present invention, the selected arbitrary starting point $E_0$ is located at an edge-side of the headbox.

The present invention is also directed to an apparatus for influencing a characteristic of a pulp suspension across a width of a headbox. The apparatus includes a plurality of adjustably positionable devices arranged across the width of the headbox.

In accordance with another feature of the present invention, the apparatus may include a fluid chamber, at least one turbulence generator, an inner chamber positioned at one of an input and an output of the turbulence generators, and at least one gap having a length extending across the width of the headbox coupling the fluid chamber to the inner chamber. Further, the length of the at least one gap may be composed of a plurality of sections and a width for each section of the at least one gap may be set in accordance with a position of a respective one of the plurality of adjustably positionable devices. Still further, the plurality of adjustably positionable devices may include a pressure pad, and a plurality of stamp elements for exerting pressure on the pressure pad such that at least one stamp element may be associated with each section of the at least one gap. A portion of the pressure pad may variably extend into a respective section of the at least one gap in accordance with the amount of pressure exerted by stamp associated with the respective section.

In accordance with yet another feature of the present invention, the fluid chamber may include a plurality of positionably adjustable walls to define a plurality of sections. Further, the fluid chamber may include a plurality of openings coupled to a fluid supply. Still further, the plurality of positionably adjustable walls may associate the plurality of openings with respective sections, and the fluid chamber may couple the openings associated with each respective section to the at least one gap.

Further, the aforementioned characteristics of the present invention and those to be mentioned below can be used not only in the respectively cited combination, but also in other combinations or in isolation, without departing from the scope and spirit of present invention.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
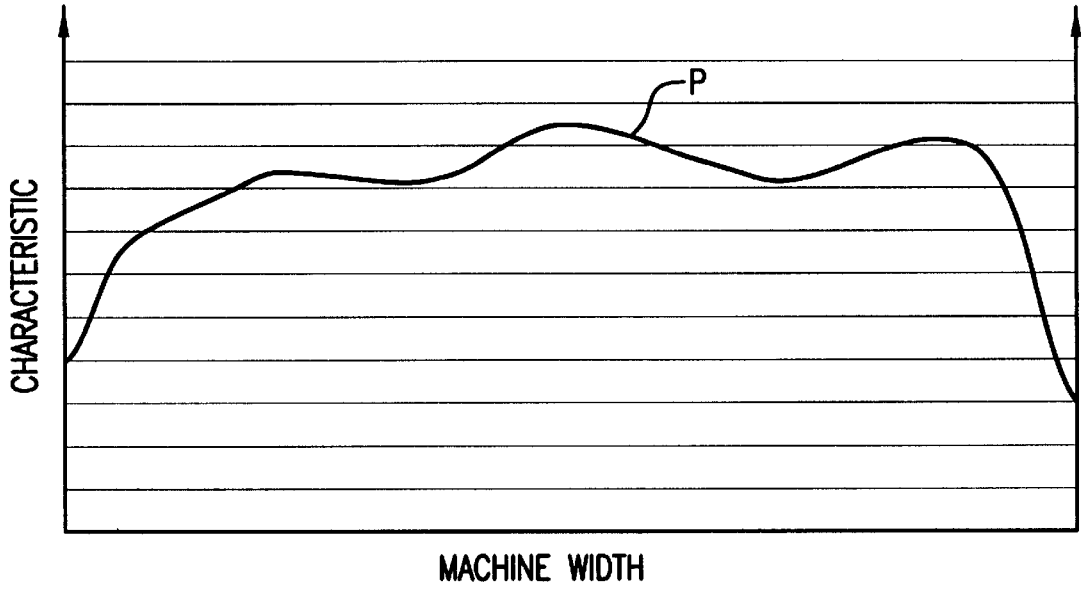
FIG. 1 illustrates an exemplary characteristic profile across the machine width.

FIG. 1 illustrates a graphic depiction of a profile P of a certain characteristic of the pulp suspension across a machine width of a headbox, e.g., spray thickness behind a jet (nozzle) of the headbox, pulp concentration, velocity of the pulp suspension, fiber orientation, entire volume of the pulp per width of the headbox, or other characteristics that have an influence on the paper being produced.

In this exemplary illustration, an alteration of the characteristic progresses more dramatically at edge regions than in mid-regions of the headbox. A profile of this type may be present, e.g., if the velocity of the pulp suspension is measured across the machine width. Because friction effects in the edge region, which are a result of the presence of the side-walls, create a reduction of spray velocity, the velocity in the edge regions decreases dramatically in comparison to the velocity in the mid-region. Moreover, while fluctuations may arise in the mid-region as well, the gradient dE/ds, where E represents the characteristic and s represents a direction transverse to a machine direction, of the characteristic E is lower than in the edge region.

The depicted exemplary curve profile of FIG. 1 shows these possible fluctuations of velocity across the machine width. The dimensional change that is depicted is somewhat exaggerated, to better depict the idea in accordance with the present invention.

Figure 2:
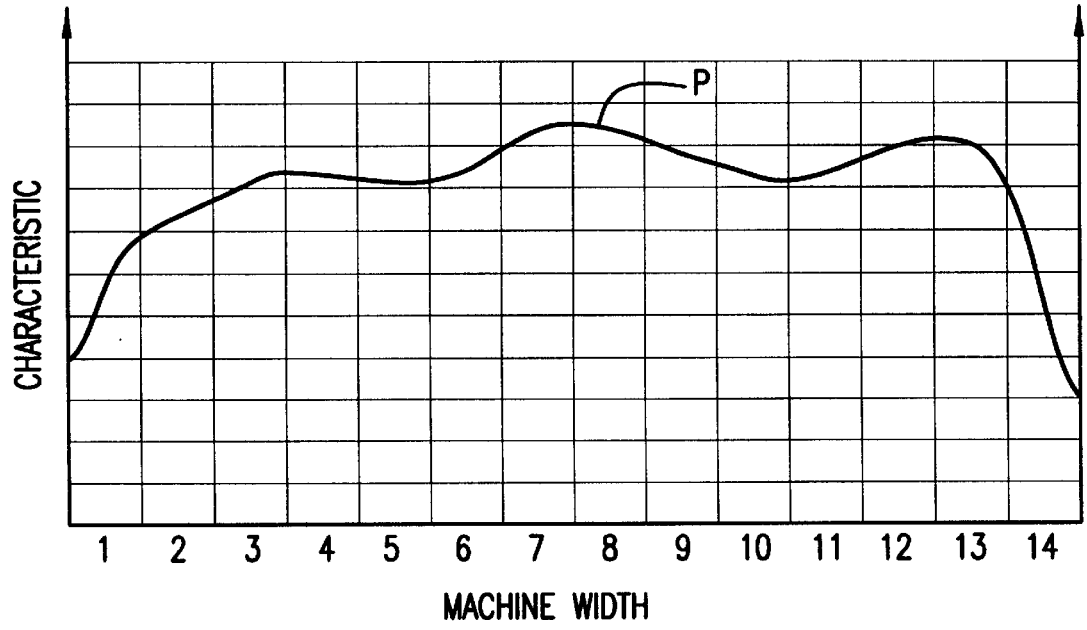
FIG. 2 illustrates the exemplary characteristic profile depicted in FIG. 1 utilizing a uniform sectioning across the machine width.

FIG. 2 illustrates the characteristic profile across the machine width as depicted in FIG. 1, in which, in accordance with the prior art, a sectioning of the headbox in sections that are equally wide is shown. In this exemplary illustration, the head box is divided into fourteen sections, each section having a same width. Looking at section 1 of characteristic profile P, the characteristic, e.g., the velocity, varies by approximately three vertical units across the one horizontal unit of section 1. In sections 2 and 3, characteristic profile P, across the range of each section, varies by approximately one unit, while through the range of sections 4 and 5, the characteristic profile P varies by less than approximately one-third of a unit. The largest variation (alteration) of characteristic profile P within a defined section occurs within section 14, in which characteristic profile P varies more than approximately 5 units across the width of section 14.

In accordance with the evenly spaced sections of the prior art, as depicted in FIG. 2, to make an adjustment of characteristic profile P in a particular section, the mean value across the entire section is corrected to a desired mean value. However, the alteration of characteristic profile P substantially remains in the particular section. In other words, even after adjustment, section 1 would continue to have a fluctuation range of approximately three units, while sections 4 and 5 would have a fluctuation range of approximately ⅙th of a unit.

However, with the permanent sectioning of the prior art, it is very difficult to perform an optimal adjustment of characteristic profile P. In particular, if the headbox is provided with very narrow sections, the arrangement leads to a high number of sections and a high number of control elements associated with each section, which leads to higher costs for the headbox. Alternatively, if the headbox is provided with fewer sections to reduce costs, then the planned alteration of the characteristic profile P is not optimal.

Figure 3:
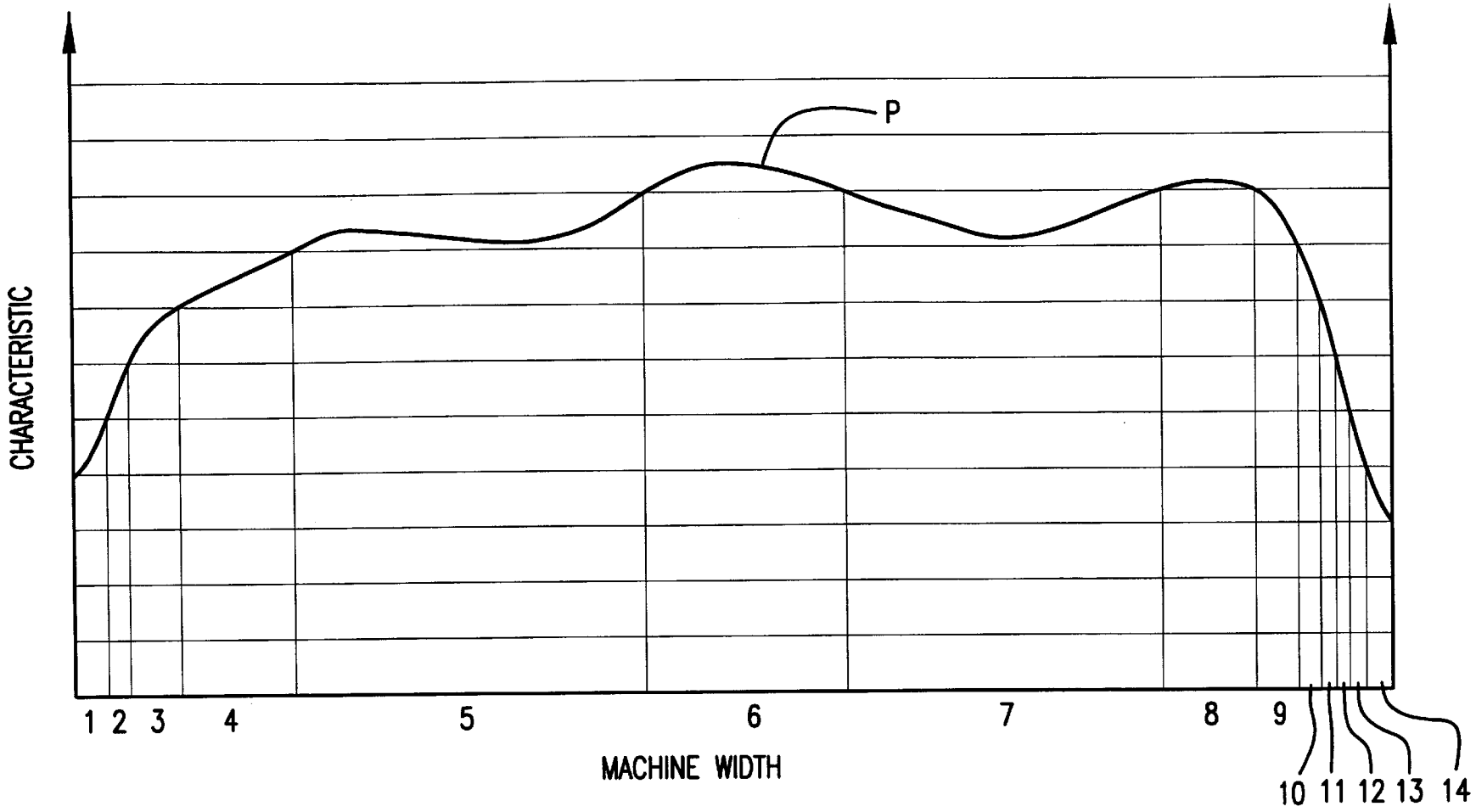
FIG. 3 illustrates the exemplary characteristic profile depicted in FIG. 1 utilizing a continuously variable sectioning in accordance with the present invention.

The present invention provides a continuously variable sectioning, as illustrated in, e.g., FIG. 3. FIG. 3 illustrates characteristic profile P, as depicted in FIGS. 1 and 2, across the machine width of the headbox. The continuously variable sectioning may be provided in the following exemplary manner: Characteristic profile P may be divided into, e.g., fourteen sections, which is the same number of sections utilized in the arrangement depicted in FIG. 2. However, in accordance with the present invention, the width of a particular section is selected such that the variation of the characteristic profile P within the particular section is not greater than one unit. Thus, the sectioning of the headbox in accordance with the present invention occurs at positions where characteristic profile P changes at a certain, predetermined extent.

Thus, while the exemplary illustration of FIGS. 2 and 3 each depict fourteen sections, the sections shown in FIG. 3 have a completely different width distribution, i.e., based upon the variation of characteristic profile P. Thus, when the variations of characteristic profile P are greatest, e.g., at the edge regions, the widths of the sections are smallest. Thus, as the characteristic gradient of characteristic profile P increases, the width of the section decreases. Conversely, very wide sections occur, e.g., in the mid-regions, because the characteristic gradients of the characteristic profile P in these regions are at their least.

As shown in exemplary FIG. 3, the characteristic profile P may divided by a plurality of equidistant horizontal lines that relate to equal units of the characteristic of interest, e.g., velocity. A point of intersection is noted for each crossing of the horizontal lines and the characteristic profile P. At each point of intersection, the respective machine width value is noted. From this graphical depiction, the specific positions and widths of the sections of the headbox may be obtained, i.e., the width is obtained from a distance, along the machine width axis, between adjacent points of intersection, and the position is obtained from a position of a respective width along the machine width axis. As discussed above, in the areas of the headbox in which the steepest changes in characteristic occur, i.e., at the edges, more sections of smaller widths are provided.

In an alternative manner of determining the width and position of the sections of the headbox, the profile a selected characteristic E of the pulp suspension in the headbox may be determined. As has been discussed above, the profile of the selected characteristic is dependent on its position s, i.e., E=f(s). An arbitrary, and preferably edge-sided, starting point $E_0$ across a machine width is selected and a maximal deviation of a characteristic $\Delta E_{max}$ is selected by the user. A nearest adjacent point $E_N$ of the characteristic profile is iteratively determined by the equation:

$$E_N = E_0 \pm |\Delta E_{max}|.$$

Adjacent point $E_N$ may be used for a next iteration as the starting point $E_0$ until an end of the machine is reached. Once the points $E_N$ are determined, the width and position of the sections of the headbox may be obtained in a manner similar to that depicted in FIG. 3. That is, the width of respective sections corresponds to a respective distance of points $E_N$, with respect to the machine width axis, and the position corresponds to an intermediate space between two adjacent points $E_N$.

The advantage of this exemplary embodiment of the present invention lies in that, after adjustments are made in respective sections of the headbox, a maximum deviation from an ideal condition is one-half a unit. Thus, by sectioning the headbox in this manner, the deviation of the adjusted characteristic profile P from the ideal condition is substantially reduced when compared with the prior art arrangement utilizing a same number of sections. That is, considering the exemplary depictions of FIGS. 2 and 3, a maximum approximation of the ideal condition in section 14 of FIG. 2 is approximately ±2.5 units, while in the embodiment of FIG. 3, an approximation of the ideal condition in each section is approximately ±0.5 units. At the same time, the number of control elements, e.g., valves or the like, utilized in both embodiments is the same, while the sectioning of the headbox is more flexible.

A further, even more effective manner of sectioning the headbox may provided by sectioning the sections so that maximum and minimum values of the characteristic can differ at a certain rate within a certain section. Thus, the number of sections may be reduced even further.

Devices for providing the flexible sectioning of the headbox are illustrated in FIGS. 4–7.

Figure 4:
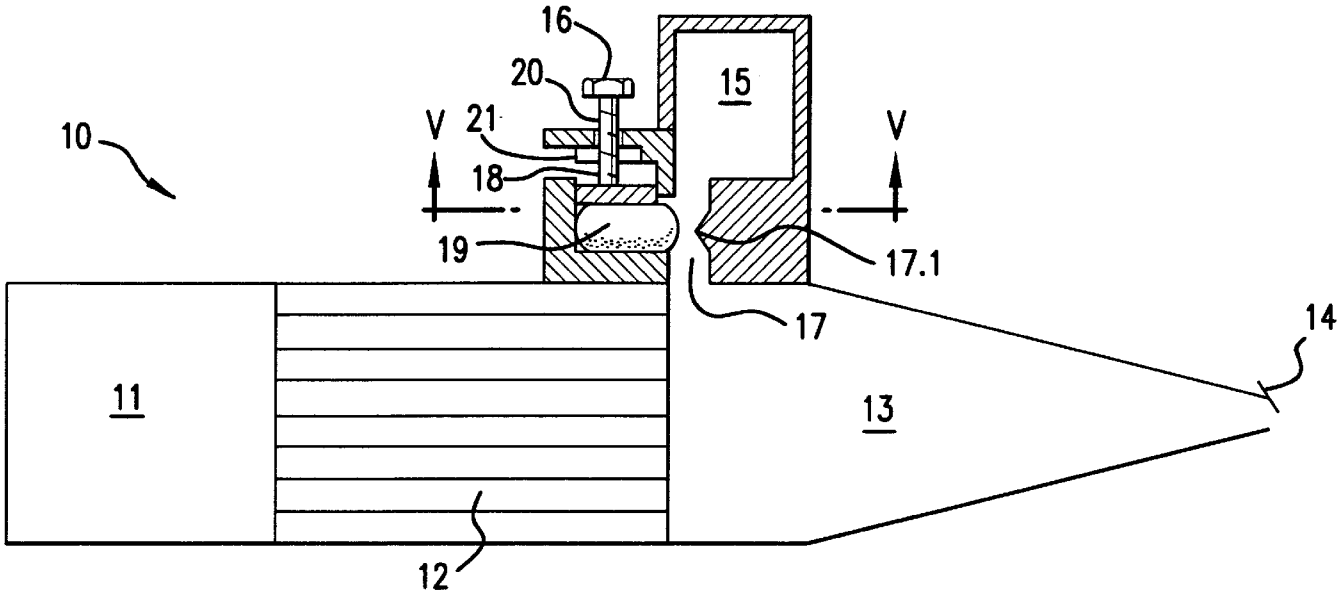
FIGS. 4 and 5 illustrate a headbox with continuously variable sectioned jetting-in of screen water.

FIG. 4 schematically illustrates a headbox 10 that includes a device for sectioned supply of pulp suspension in which the widths of the individual sections can be continuously adjusted. The schematic depiction of the device for sectioned supply of pulp suspension is taken along section lines IV—IV of FIG. 5. Headbox 10 may include a lateral distributor 11, a subsequently positioned turbulence generator 12, and a nozzle 13 coupled to turbulence generator 12. A restrictor 14 is associated with nozzle 13. A channel 15 is provided in an upper side of headbox 10, e.g., in a region of an outlet of turbulence generator 12, and positioned to extend across a machine width to feed into an upper region of nozzle chamber 13 via a chamber 17. Chamber 17 may have a length that corresponds to the machine width an opening gap (width) that may be altered via a stamp 18 acting upon a pressure pad 19. Stamp 18 may include a variable width, i.e., variable in a direction lateral to the machine direction, that may apply a variable pressure upon pressure pad 19 via a screw 16. As more pressure is applied by stamp 18 upon pressure pad 19, a greater bulging of a portion of pressure pad 19 occurs, which narrows the gap of channel 17 at the section associated with stamp 18. Moreover, a progression or node 17.1 may be provided in chamber 17 for a better apportioning. Screws 16 may be guided through a slot 20 to create the counterpressure via a square 21 having a bore and thread. The counterpressure is utilized to adjustably position stamp 18, thereby exerting pressure on pressure pad 19. In this manner, screws 16 may be applied or located in arbitrary positions so that only the width of stamp 18 must be adjusted individually to the variable size of the desired section. This adjustment may occur, e.g., via telescope-like embodiments of the stamp or via a plurality of supplied stamps of varying widths, which may be used in accordance with operational necessity.

Figure 5:
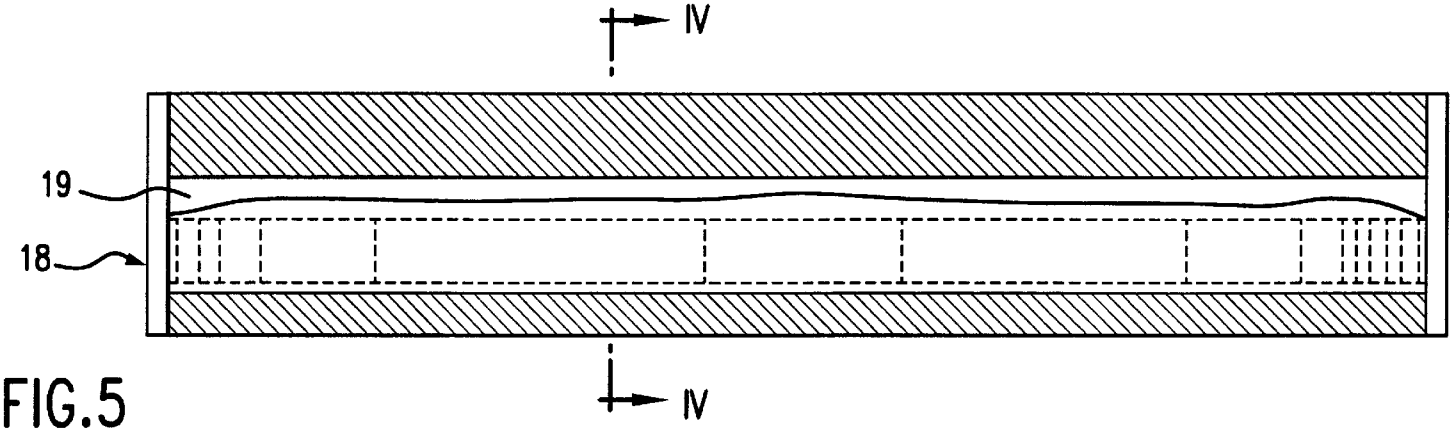

FIG. 5 shows a view along section V—V of FIG. 4. Characteristic profile P of FIG. 1 and the sectioning of the headbox in accordance with FIG. 3 of the present invention are schematically illustrated. The bulging of pressure pad 19, which occurs due to the arrangement discussed above, i.e., pressure applied by stamps 18 and screws 16 (not shown), substantially corresponds to the necessary adjustment of characteristic profile P from FIG. 1.

Figure 6:
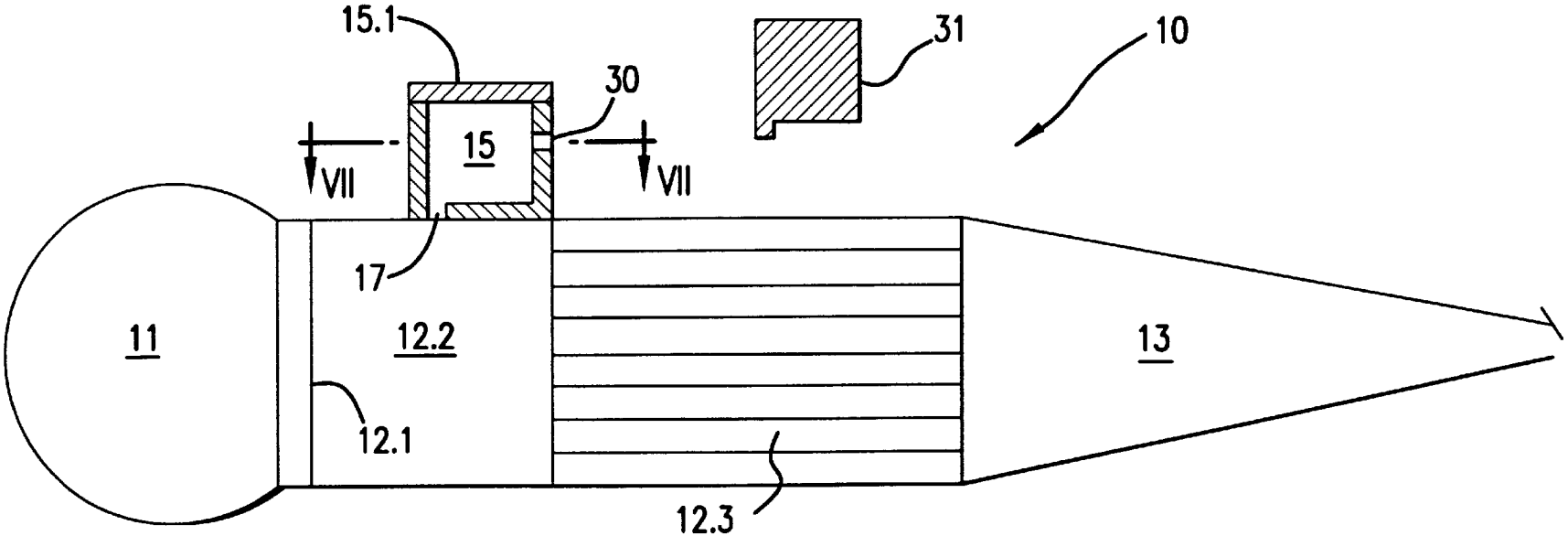
FIGS. 6 and 7 illustrate a headbox with sectioned jetting-in of screen water and continuously variable adjustable partition walls.

FIG. 6 shows an alternative embodiment of the present invention of a continuously variable sectioned screen (sieve) water apportioning at a headbox. Headbox 10 includes a lateral distributor 11 that feeds a distribution grid 12.1. An intermediate channel 12.2, which is not sectioned, follows distribution grid 12.1. Intermediate channel 12.2 is coupled to a turbulence generator 12.3, and a nozzle 13 is coupled to turbulence generator 12.3. A channel 15, extending machine-wide, is shown located over the intermediate channel 12.2, and includes a cap 15.1 located on a top side, and a plurality of openings 30. In contrast to the embodiment depicted in FIG. 4, channel 15 is positioned on the input side of the turbulence generators.

Openings 30 are utilized to receive diluting fluid to be apportioned and to be fed into channel 15. Partition walls 31 (of which one is shown outside of channel 15) may be inserted into channel 15 through cap 15.1 at desired points for sectioning the headbox to be either continuously variable or in very small, discrete steps. If channel 15 is sectioned via partition walls 31 in accordance with a characteristic profile, then the sections are fed with diluting fluid via one or more supply line(s) via openings 30. Each of the lines that lead to a section are influenced via a corresponding distributor via a single control element.

Figure 7:
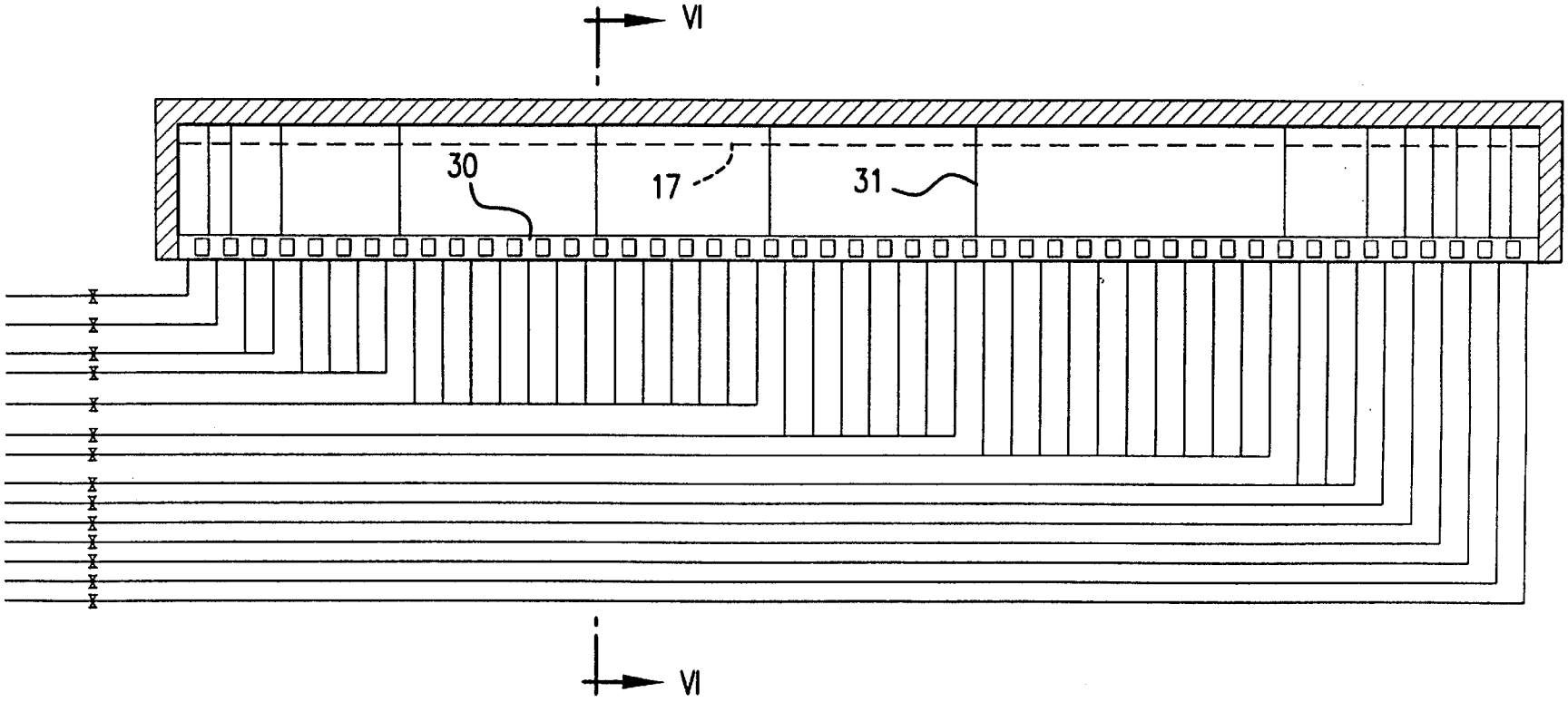

FIG. 7 shows a view of section VI—VI of FIG. 6. As shown, supply lines coupled to openings 30 of channel 5 for the individual sections with their respective distributors and control elements are only schematically depicted. For example, as noted above, all of the supply lines coupled to the openings 30 for a respective section may be associated with a single control element. Thus, when, as shown in FIG. 7, channel 15 is divided into fourteen sections, the headbox only requires one control element per section, thus reducing costs.

It is noted that the foregoing examples have been provided merely for the purpose of explanation and are in no way to be construed as limiting of the present invention. While the present invention has been described with reference to particular embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular devices, means, materials and embodiments, the present invention is not intended to be limited to the particulars disclosed herein; rather, the present invention extends to all functionally equivalent structures, methods and uses, such as are within the scope of the appended claims.

Reference List

P Characteristic Profile
10 Headbox
11 Lateral Distributor
12 Turbulence Generator
12.1 Distribution Grid
12.2 Intermediate Channel
12.3 Turbulence Generator
13 Nozzle
14 Restrictor
15 Channel
15.1 Cap
16 Screw
17 Channel
17.1 Progression
18 Stamp
19 Pressure Pad
20 Slit
21 Square
30 Openings
31 Partition Wall

What is claimed:

1. A process for determining a position and width of sections of a headbox comprising:

measuring a profile of at least one characteristic of a pulp suspension that varies across a width of the headbox;

uniformly dividing the at least one characteristic profile into substantially same sized units related to the at least one characteristic;

indicating points of intersection on the at least one characteristic profile of the same sized units related to the at least one characteristic;

ascertaining a width of a respective section in accordance with a respective distance, with respect to the width of the headbox, between two adjacent points of intersection on the at least one characteristic profile;

ascertaining a position of the respective section in accordance with a position of an intermediate space located between the two adjacent points of intersection on the at least one characteristic profile.

2. A process for determining the position and width of the sections of a headbox comprising:

determining a profile of a selected characteristic E of a pulp suspension in the headbox that varies in accordance with a position s across the head box, such that E=f(s);

selecting an arbitrary starting point $E_0$ along a machine width;

determining a maximal deviation of the selected characteristic $\Delta E_{max}$;

iteratively determining a nearest adjacent point $E_N$ of the selected characteristic profile, for which the following relation is satisfied:

$$E_N = E_0 \pm |\Delta E_{max}|,$$

where adjacent point $E_N$ is utilized for a next iteration as starting point $E_0$ until an end of the machine width is reached;

determining a width of the sections that corresponds to a respective distance between the points $E_N$; and determining a position from an intermediate space between two adjacent points $E_N$.

3. The process in accordance with claim 2, wherein the selected arbitrary starting point $E_0$ is located at an edge-side of the headbox.

4. The process in accordance with claim 1, wherein the width of the headbox is a machine width.

* * * * *